United States Patent [19]

Ruffle et al.

[11] Patent Number: 4,757,766

[45] Date of Patent: Jul. 19, 1988

[54] ARMOR-PENETRATING AMMUNITION ASSEMBLY WITH ALUMINUM PROTECTIVE CAP

[75] Inventors: Paul D. Ruffle, Edina; Randall L. Schiestl, Brooklyn Park; Robert L. Bonde, Minneapolis, all of Minn.

[73] Assignee: Honeywell Inc., Minneapolis, Minn.

[21] Appl. No.: 7,851

[22] Filed: Jan. 28, 1987

[51] Int. Cl.[4] ..... F42B 13/16

[52] U.S. Cl. ..... 102/521; 102/703

[58] Field of Search ..... 102/501, 520–523, 102/703

[56] References Cited

U.S. PATENT DOCUMENTS

| | | | |
|---|---|---|---|
| 3,446,147 | 5/1969 | Engel et al. | 102/522 |
| 4,142,467 | 3/1979 | Stahlmann et al. | 102/523 |
| 4,372,217 | 2/1983 | Kirkendall et al. | 102/521 |
| 4,517,899 | 5/1985 | Haberli | 102/521 |
| 4,535,698 | 8/1985 | Yuen | 102/521 |

*Primary Examiner*—Harold J. Tudor

*Attorney, Agent, or Firm*—E. W. Hughes; R. W. Jensen

[57] ABSTRACT

An armor-penetrating ammunition assembly is provided with a multiple segment aluminum protective cap 26. The cap 26 is provided with a plurality of stiffening ribs 34, 34′, 35, 35′, and torque resisting tabs 40, 40′ which rest in one of the grooves 37, 37′ defined by the ribs 34, 34′. Additional stiffening is provided by rolled stiffening portions 36, 36′ at the trailing end 32 of cap 28 and by longitudinal ribs 38, 38′ at the longitudinal edges of each segment 28, 28′ of the cap 26. Attachment structure is provided for forming a fixed interconnection between each segment 28, 28′ of the cap 26 and a corresponding portion 19, 19′ of the sabot 18. Thus, each segment 28, 28′ of the cap 26 remains attached to a corresponding sabot portion 19, 19′ as each portion 19, 19′ of the sabot 18 separates from the penetrator 12 at muzzle exit without disturbing the flight of the penetrator 12.

19 Claims, 1 Drawing Sheet

ARMOR-PENETRATING AMMUNITION ASSEMBLY WITH ALUMINUM PROTECTIVE CAP

The Government has rights in this invention pursuant to Contract No. DAAK10-82-C-0296, awarded by the Department of the Army.

BACKGROUND OF THE INVENTION

1. Field of the Invention

This invention is in the field of protective caps for small caliber Armor-Penetrating Fin-Stabilized Discarding-Sabot (APFSDS) ammunition. The purpose of such caps is to protect the fin stabilized penetrator during rough handling including feeding and chambering a round in an automatic cannon to maintain undamaged the smooth surface at the forward end of the penetrator so that the trajectory of the fin stabilized penetrator, or projectile, does not significantly deviate from its predicted trajectory.

2. Description of the Prior Art

Conventional small-caliber APFSDS projectile consists of a fin-stabilized, armor piercing penetrator which is supported in the bore of an automatic cannon by means of a multiple segment two-piece sabot. Typically, the penetrator has a cylindrical body portion measuring approximately 8.3 mm in diameter, and a leading portion which tapers to a fine point for low aerodynamic drag. It is crucial that the point of the penetrator be wellprotected, since mishandling can result in the point becoming dented scratched or bent. Damage of this nature is clearly undesirable, since any irregularities in the streamlined surface of the penetrator will significantly increase its aerodynamic drag and thus, cause its trajectory to deviate significantly from its predicted trajectory which is based on the assumption that the leading, or tapered front, end portion of the penetrator will not be dented, scratched, or bent.

To prevent such damage from occurring, the projectile is normally provided with a one-piece protective cap which is fastened to the front end of the sabot. The cap protects the tapered front end of the penetrator during rough handling and provides a smooth surface at the forward end of the ammunition so that a cartridge which includes a sabot and penetrator will feed and chamber in an automatic cannon without damaging the penetrator. In addition, the cap is designed to separate from the sabot and the sabot from the projectile as the projectile exits the muzzle of a cannon in such a way that neither the cap nor the sabot interferes with the flight of the projectile.

In the past, such one-piece protective caps have been molded from polyethylene. Typically, such caps are molded with a reduced-diameter section enabling them to be snap-fit over a cooperating lip portion of the sabot. When a cartridge fitted with one of these caps is fired from an automatic cannon, a combination of air ram pressure and centrifugal force causes the cap to split and detach from the sabot thus allowing the projectile to fly unimpeded, or without deviating from its desired trajectory.

It has been found, however, that conventional polyethylene caps do not function as effectively as desired. They separate prematurely from the sabot during rough handling, leaving the tapered portion of the penetrator unprotected. At other times, they have failed to split and detach from the sabot or have fragmented in such a way as to disturb the flight of the projectile. Thus, the accuracy and effectiveness of the projectile has been impaired.

Therefore, a need exists for a new and improved protective cap for small-caliber APFSDS ammunition, which provides better protection of the penetrator during handling, and which breaks apart "cleanly" at muzzle exit, detaching from the projectile without significantly disturbing the flight of the projectile and thus adversely affecting its accuracy, predicted trajectory, and its terminal velocity and, thus, its ability to penetrate a target.

SUMMARY OF THE INVENTION

The present invention overcomes the shortcomings of the prior art by providing a multiple segment aluminum protective cap for a fin stabilized armor piercing projectile. The cap is provided with a plurality of stiffening ribs, and torque resisting tabs which rest in the groove defined by one of the ribs. Additional stiffening is provided by longitudinal ribs at the longitudinal edges of each segment of the cap. Because the cap consists of a plurality of segments which are held together only by the force of the side walls of the cannon bore, little or no energy is required to separate the segments of the cap at muzzle exit. In addition, because the cap is aluminum, it is stronger, and stiffer than a polyethylene cap, and therefore provides better protection during rough handling. Cooperating attachment elements are provided on the forward end of the sabot and the rear end of the cap to produce a fixed interconnection between each segment of the cap and a corresponding sabot segment. Because each cap segment remains attached to its attached sabot segment as they separate from the projectile, the risk of a cap segment interfering with the trajectory of the projectile is significantly reduced.

BRIEF DESCRIPTION OF THE DRAWINGS

The invention will be better understood from the following description when read in conjunction with the following drawings, wherein.

DETAILED DESCRIPTION OF THE PREFERRED EMBODIMENT

Figure 1:
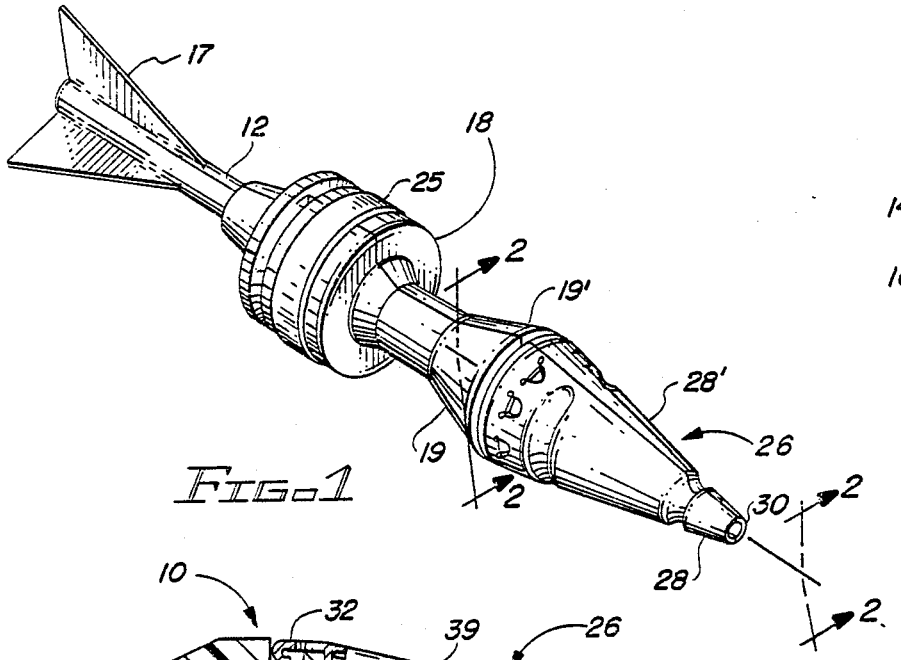
FIG. 1 is a perspective view of a small caliber armor penetrating fin discarding sabot projectile with the sabot having the protective cap of this invention mounted on it.
Figure 3:
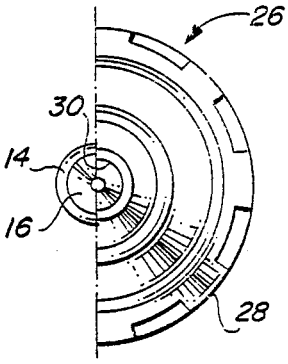
FIG. 3 is a front view showing one segment of a protective cap assembled about a penetrator.
Figure 2:
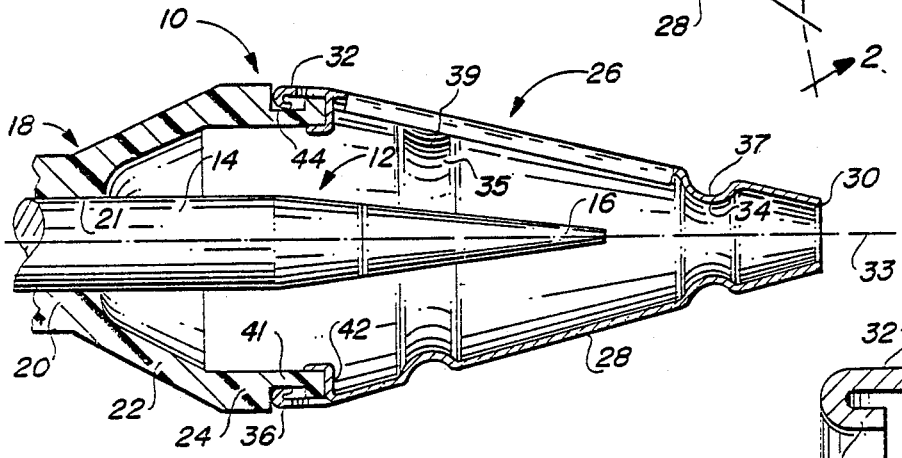
FIG. 2 is a section taken on line 2—2 of FIG. 1.
Figure 5:
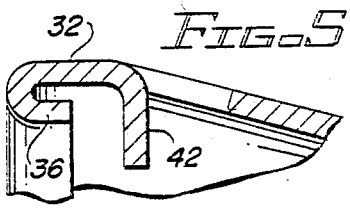
FIG. 5 is an enlarged fragmentary section showing one of the attachment tabs of the cap before assembly.

The armor penetrating ammunition assembly consists of projectile 10 in fin stabilized armor-piercing penetrator 12, sabot 18 and protective cap 26. Penetrator 12 has a cylindrical body 14, a tapered leading tip 16 and is provided with stabilizing fins 17. Projectile 10 is supported in the bore of an automatic cannon by sabot 18 consisting of a plurality, two in the preferred embodiment, of mating portions, or segments, 19, 19'. When assembled about the penetrator 12, sabot 18 forms a continuous structure, or shell, having a cylindrical portion 20 defining a bore 21 for receiving the body of the penetrator 12 and a flared forward portion 22 having a circular front end 24. The two segments 19, 19' of sabot 18 are held together by obturating band 25. The outer diameter of obturating band 25, which is made of a suitable thermoplastic material such as Nylon 6/6 is greater than that of sabot 18 so that the lands of the rifling of the gun barrel from which projectile 10 is fired are fully engraved in band 25 when sabot 18 exits the barrel.

Figure 4:
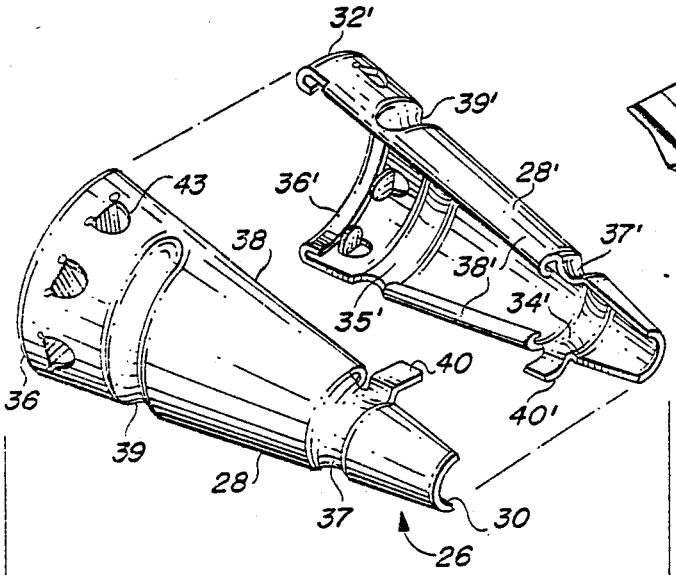
FIG. 4 is a perspective view of the two segments of the protective cap in exploded relation.

Fastened to the front end of sabot 18 is aluminum protective cap 26. Like sabot 18, protective cap 26 consists of a plurality, two discrete in the preferred embodiment, of mating portions, or segments as best seen in FIG. 4 28, 28'. The two segments, when assembled, form a continuous substantially conical shell, having an open leading end 30 and an open trailing end 32. Cap 26 is substantially symmetric with respect to its longitudinal axis 33. The outer diameter of the trailing end 32 is less than the outer diameter of the circular front end 24 of sabot 18. This ensures that projectile 10 will feed and chamber smoothly in the bore of an automatic cannon, and no additional stress will be put on base 32 of cap 26 when assembly 10 is fired.

Cap 26 has also been provided with a number of features which increase its stiffness and strength. It is, for instance, provided with a plurality of stiffening ribs 34, 34' 35, 35' and corresponding grooves 37, 37', 39, 39' spaced along the length of the cap. Rib 34, 34' extends completely around cap 36 or is circumferential while ribs 39, 39' extend only partially around cap 26, terminating before reaching the longitudinal edges of cap segments 28, 28'. Also, the bottom, or aft, edge of each cap segment 28, 28' is rolled inwardly to form another circumferential stiffening portion 36, 36'. Similarly, the longitudinal edges of each cap segment are rolled inwardly to provide longitudinal reinforcement ribs 38 and 38' extending from circumferential rib 34 to trailing end 32. Still more reinforcement is provided by torque resisting tabs 40, 40' which project from the forwardmost circumferential rib portions 34, 34' of each cap segment 28, 28' and rest in the recess or groove 37, 37' formed by the circumferential stiffening ribs 34, 34' when cap 26 is assembled.

Torque resisting tabs 40, 40' resist any twisting of a cap half such as cap half 28 relative to sabot segment, or portion 19, to which it is fixedly attached as the projectile 10 and sabot 18 are subjected to a large angular acceleration about longitudinal axis 33 when they travel down the barrel of a cannon after being fired. Maintaining the alignment of each sabot segment 19, 19' with its attached cap segment 28, 28', significantly increases the reliability with which the sabot segments 19, 19' and attached cap segments 28, 28' cleanly separate from projectile 10 as projectile 10 exits the mouth of the cannon from which projectile 10 is fired.

Figure 6:
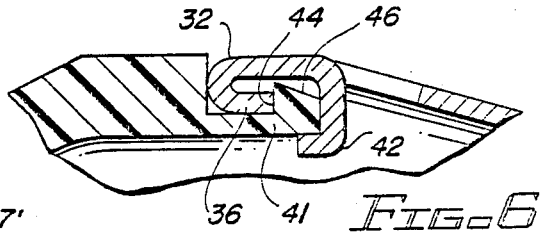
FIG. 6 is an enlarged fragmentary section through one of the attachment tabs of the cap secured to the attachment lip of the sabot after assembly.

The means for fastening protective cap 26 to sabot 18 consists of attachment lips, or projections, 41, 41' on the front end 24, 24' of the two segments 19, 19' of sabot 18, which cooperate with the four attachment tabs 42, and four attachment tabs 42' projecting inwardly proximate the trailing ends 32, 32' of the two segments 28, 28' of protective cap 26. Each of the tabs 42, 42' is formed by cutting a semicircular arc 43, 43' into the aluminum walls of cap 26 and by pressing the area inscribed by this arc inwardly, as is best illustrated in FIG. 6. When cap 26 is assembled with sabot 18, rolled bottom edges 36, 36' rest in recessed notch portion 44, 44' of sabot 18, and each of the attachment tabs 42, 42' is then mechanically crimped over angular, or sloping, portions 46, 46' at the forward end of sabot 18, as is best illustrated in FIG. 6. This forms a fixed interconnection between each segment 19, 19' of sabot 18 and its corresponding cap segments 28, 28'. By "fixed interconnection", is meant that each cap segment 28, 28' remains fastened to a sabot segment 19, 19' to which it is secured after projectile 10 has been fired from a cannon and sabot 18 has separated from penetrator. In this way, cap 26 and sabot 18 separates from penetrator 12 at muzzle exit without disturbing the trajectory of penetrator 12.

While the principles of the invention have now been made clear in the illustrated embodiments, it will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

We claim as our invention:

1. An armor-penetrating ammunition assembly comprising:

a fin stabilized projectile 10 including a penetrator 12 having a tapered leading tip 16;

a discarding sabot 18 for positioning said penetrator 12 in the bore of an automatic gun, said sabot 18 comprising a plurality of substantially identical mating segments 19, 19' which, when assembled around the penetrator 12, comprise a cylindrical portion 20 defining a bore 21 for receiving said penetrator 12, and a flared forward portion 22 having a circular front end 24 having an outside diameter;

a protective cap 26, comprising a plurality of discrete metallic segments 28, 28' said segments 28, 28' when assembled, forming a substantially continuous conical housing around the leading tip 16 of said penetrator 12, said cap having a longitudinal axis 33, an open leading end 30, and an open trailing end 32, said trailing end 32 having an outside diameter which is less than the outside diameter of the circular front end 24 of the flared forward portion 22 of the sabot 18; and fastening means comprising cooperating elements on the forward portion 24, 24' of said sabot 18 and the rear portions 32 of said protective cap 26, said fastening means forming a fixed interconnection between each segment of the protective cap 28, 28' and sabot segment 19, 19' respectively, each segment 28, 28' of the cap 26 remaining attached to a sabot segment 19, 19' as the segments 19, 19' of the sabot 18 separate from the penetrator 12 after the assembly is fired from a gun.

2. The armor-penetrating ammunition assembly of claim 1, in which the protective cap 26 is made of aluminum.

3. The armor-penetrating ammunition assembly of claim 2 in which each segment 28, 28'' of protective cap 26 has a pair of longitudinal edges 38, 38', and the longitudinal edges of each segment 28, 28' are rolled inwardly, forming longitudinal reinforcement ribs 38, 38'.

4. The armor-penetrating ammunition assembly of claim 3, in which each segment 28, 28' of the protective cap 26 has a plurality of circumferential stiffening ribs 34, 34', 35, and 35'.

5. The armor-penetrating ammunition assembly of claim 4, in which the circumferential stiffening rib 34, 34', defines a circumferential groove in the surface of the cap segments 28, 28'.

6. The armor-penetrating ammunition assembly of claim 5, in which each segment 28, 28' of the cap 26 further comprises a torque resisting tab 40, 40' which projects from the circumferential rib 34, 34' and is received in the groove 37, 37' defined by the rib 34, 34' of the mating segments 28, 28'.

7. The armor-penetrating ammunition assembly of claim 6, in which the cooperating elements of said fastening means comprise:

an attachment lip 41 on the circular front end 24 of the sabot 18, said lip having an angular portion 46, and a recessed notch 44; and a plurality of attachment tabs 42 extending inwardly proximate the trailing end 32 of said protective cap 26;

each of said attachment tabs 42 being mechanically crimped over the angular portion 46 of the sabot 18.

8. The armor-penetrating ammunition assembly of claim 7 in which the cooperating elements of the fastening means comprise four attachment tabs 42, 42' on each segment 28, 28' of the protective cap 26.

9. The armor-penetrating ammunition assembly of claim 7, in which each of said attachment tabs 42, 42' is an integral portion of said protective cap 26 and is bent inwardly towards the longitudinal axis 33 of the cap 26.

10. The armor-penetrating ammunition assembly of claim 9 in which the number of mating segments 19, 19' of sabot 18 and the number of mating segments of protective cap 26 equals two.

11. An armor penetrating ammunition assembly as defined in claim 10 in which the trailing end 32 of the protective cap 26 includes rolled stiffening portions 36, 36'.

12. In an armor-penetrating ammunition assembly including a fin stabilized projectile 10, wherein the improvement comprises:

a sabot 18 including a plurality of segments 19, 19' having an outside diameter and fastening means 41, 41';

a protective cap 16 including a plurality of discrete metallic segments 28, 28' which, when assembled, form a substantially continuous conical shell having an inner surface and an outer surface, an open leading end 30 and an open trailing end 32, said trailing end 32 having an outside diameter which s less than the outside diameter of the sabot 18 there being at least one segment 28 of cap 26 for each segment 19 of sabot 18; and fastening means 42, 42' proximate said trailing end 32, 32' of each of said segments 28, 28' of said cap 26, said fastening means forming a fixed interconnection with the fastening means 41, 41' of each segment 19, 19' of the sabot 18.

13. In the assembly of claim 12 wherein the segments 28, 28' of cap 26 are made of aluminum.

14. In the assembly of claim 13 in which each segment 28, 28' of protective cap 26 has longitudinal edges 38, 38' and the longitudinal edges of each segment 28, 28' are rolled inwardly, forming longitudinal reinforcement ribs 38, 38'.

15. In the assembly of claim 14 in which each segment 28, 28' of the protective cap 26 has a plurality of stiffening ribs 34, 34', 35, 35'.

16. In the assembly of claim 15 in which the stiffening rib 34, 34', 35, 35' defines a corresponding groove 37, 37', 39, 39' in the outer surface of the cap segments 28, 28', said grooves 37, 37', 39, 39' having a substantially arcuate cross section.

17. In the assembly of claim 16, in which each segment 28, 28' of the cap 26 comprises a torque resisting tab 40, 40' which projects from the forward circumferential rib 34, 34' and is received in the groove 37, 37' defined by the rib 34, 34' of another cap segment 28, 28'.

18. In the assembly of claim 17 in which said fastening means comprises a plurality of attachment tab means 42, 42' projecting inwardly from the inner surface of cap 26 proximate the trailing end 32, said attachment tab means 42, 42' being mechanically crimped over corresponding attachment means 41 of the sabot 18.

19. In the assembly of claim 18 in which the number of segments 19, 19' of sabot 18 and the number of segments 28, 28' of cap 26 both equal two.

* * * * *